US007837090B2

(12) United States Patent
Bostian

(10) Patent No.: US 7,837,090 B2
(45) Date of Patent: Nov. 23, 2010

(54) FOLDED PRODUCT CONTAINER THAT IS FORMED AS A REINFORCED OPENED TOP DISPLAY TRAY THAT CAN BE STACKED

(75) Inventor: Myron E. Bostian, Gold Hill, NC (US)

(73) Assignee: Supply One Rockwell, Inc., Rockwell, NC (US)

( * ) Notice: Subject to any disclaimer, the term of this patent is extended or adjusted under 35 U.S.C. 154(b) by 406 days.

(21) Appl. No.: 11/839,307

(22) Filed: Aug. 15, 2007

(65) Prior Publication Data

US 2008/0054061 A1 Mar. 6, 2008

Related U.S. Application Data

(60) Provisional application No. 60/823,778, filed on Aug. 29, 2006.

(51) Int. Cl.
*B65D 5/00* (2006.01)
*B65D 5/02* (2006.01)
*B65D 5/28* (2006.01)

(52) U.S. Cl. ..... 229/164; 229/185.1; 229/191; 229/178; 229/179; 229/915; 229/170; 229/169

(58) Field of Classification Search ..... 229/164, 229/185.1, 191, 178, 179, 915, 170, 169
See application file for complete search history.

(56) References Cited

U.S. PATENT DOCUMENTS

| | | | | | |
|---|---|---|---|---|---|
| 2,885,137 | A | * | 5/1959 | Guyer | 229/125.19 |
| 3,079,058 | A | * | 2/1963 | Russell | 229/125.21 |
| 3,375,967 | A | * | 4/1968 | Robinson | 229/178 |
| 3,918,630 | A | * | 11/1975 | Meyers | 229/191 |
| 4,546,913 | A | * | 10/1985 | Castillo | 229/165 |
| 5,487,505 | A | * | 1/1996 | Nilsson | 229/191 |
| 5,992,735 | A | * | 11/1999 | Oosterbaan | 229/191 |

FOREIGN PATENT DOCUMENTS

| | | | |
|---|---|---|---|
| EP | 394544 | A1 * | 10/1990 |
| GB | 2264484 | A * | 9/1993 |

* cited by examiner

*Primary Examiner*—Gary E Elkins
*Assistant Examiner*—Latrice Byrd
(74) *Attorney, Agent, or Firm*—Thompson Coburn LLP; Joseph Rolnicki, Esq.

(57) ABSTRACT

A folded product container provides the benefit of reduced cost of a container formed from a single sheet of material that is folded to produce the container without requiring gluing. The novel configuration of the folded container provides four triangular cross-section column walls at the four corners of the container that reinforce the container for stacking, while still allowing display of products in the container through a top opening and front and rear openings of the stacked containers.

18 Claims, 4 Drawing Sheets

FOLDED PRODUCT CONTAINER THAT IS FORMED AS A REINFORCED OPENED TOP DISPLAY TRAY THAT CAN BE STACKED

This Patent Application claims the benefit of the filing date of Provisional Patent Application No. 60/823,778, which was filed on Aug. 29, 2006.

BACKGROUND OF THE INVENTION (1) Field of the Invention

The present invention pertains to a folded product container that is cut from a single sheet of material and is folded, without glue, into a tray configuration with four corner columns that reinforce the tray and enable stacking of several trays, and with an open top for the display of products contained in the tray.

(2) Description of the Related Art

There area many different types of folded containers that are constructed of cardboard or paperboard or other similar type of material that are primarily designed to contain products as the products are shipped and stored. There are also folded containers of this type that serve as a display for the products packaged in the container when the products are put out in a store for purchase by consumers. Typically, in these types of folded containers, a portion of the folded container is removed so that the container can function as a display for the sale of the products contained in the container.

When used as a display in a store, several of these types of folded containers are often stacked so that consumers can easily view several different types of the products contained in the stacked containers. Because folding cartons of this type are often stacked when storing products, transporting products, and displaying products, the folding container must have a sufficiently rigid construction so that the container will not be crushed or deformed when positioned at the bottom of a stack of containers.

Folding containers that have removable portions that create a display from the containers often have reduced structural rigidity due to the removed portions. This presents the problem of the folding containers with the removed portions potentially being crushed or deformed when positioned at the bottom of a stack of such containers.

To reduce the potential for folding display containers being crushed or deformed by other containers stacked on the display container, the containers often have portions that are glued together. The gluing together of the container portions increases of the structural rigidity of the container. However, the gluing requires an additional manufacturing step in producing the containers, which adds to the manufacturing cost of the containers. Still further, even folded containers with glued portions may not have sufficient structural rigidity to prevent the container from being crushed or deformed when used to display products in a stack of containers.

SUMMARY OF THE INVENTION

The folded product container of the invention overcomes many of the disadvantages associated with prior art folded product containers that are used in the storage, shipping, and display of products and are often stacked when storing, shipping, and displaying products. The folded product container of the invention is cut from a single sheet of material, thereby providing a reduction in the manufacturing cost of the container. Furthermore, the folded container of the invention is assembled without requiring a gluing step, thereby further reducing the manufacturing cost of the container. The configuration of the container has an open top, front, and sometimes back allowing products to be displayed in the container, without requiring a portion of the container to be removed to produce the open top. The folded container also has reinforced corners that enable several of the containers to be stacked when storing products, shipping products, and displaying products, with a reduced potential for the container being crushed or deformed when stacked.

The novel configuration of the folded product container of the invention enables it to be cut from a single sheet of material. The novel configuration also enables the folded containers to be assembled from the single sheet of material without gluing any portion of the container.

The container is formed with a rectangular bottom panel having parallel front and rear edges and parallel left side and right side edges. The bottom panel could also be square.

A front panel is connected integrally with the bottom panel along the bottom panel front edge. The front panel extends upwardly from the bottom panel front edge. A front flap is connected integrally with the front panel on an opposite side of the front panel from the bottom panel. The front flap is folded over the front panel to reinforce the front panel.

A rear panel is connected integrally with the bottom panel along the bottom panel rear edge. The rear panel is constructed in the same manner as the front panel and includes a rear flap that is folded over the rear panel to reinforce the rear panel.

A left side panel is connected integrally with the bottom panel along the bottom panel left side edge. The left side panel extends upwardly from the bottom panel left side edge. The left side panel meets with the front panel and forms a front, left corner of the container. The left side panel also meets with the rear panel and forms a rear, left corner of the container.

A right side panel is connected integrally with the bottom panel along the bottom panel right-side edge. The right side panel is constructed in the same manner as the left side panel and extends upwardly from the bottom panel right side edge. The right side panel meets with the front panel and forms a front, right corner of the container. The right side panel also meets with the rear panel and forms a rear, right corner of the container.

The left side panel has four, elongated rectangular column panels that are connected integrally with the left side panel adjacent the front, left corner of the container. In assembling the container of the invention, these four column panels are folded across four fold lines toward the left side panel to form a triangular cross-section column in the container at the front, left corner of the container. This triangular cross-section column provides reinforcement in the corner of the container between the left side panel and the front panel.

The opposite end of the left side panel adjacent the rear, left corner of the container also has four, elongate rectangular column panels connected integrally with the left side panel. These four column panels are folded across four fold lines toward the left side panel to form a triangular cross-section column inside the container at the rear, left corner of the container. This second triangular cross-section column reinforces the container at the corner formed between the left side panel and the rear panel.

In a like manner, the right side panel has four, elongate rectangular column panels connected integrally with the right side panel adjacent the front, right corner of the container, and four column panels connected integrally with the right side panel adjacent the rear, right corner of the container. These four column panels at the opposite sides of the right side panel are folded across fold lines toward the right side panel to produce a triangular cross-section column at each of the front, right corner and rear, right corner of the container. These columns also reinforce the container at the corner formed between the right side panel and the front panel and the corner formed between the right side panel and the rear panel.

Thus, the four triangular cross-section columns are formed in the folded container without requiring gluing, with the columns reinforcing the container and enabling several like containers to be stacked while avoiding crushing or deforming the containers.

Additionally, the front and rear panels have equivalent height dimensions extending upwardly from the bottom panel and the left side panel and right side panel also have equivalent height dimensions extending upwardly from the bottom panel. The left side panel and right side panel height dimension is larger than the height dimension of the front panel and rear panel. This produces a top opening in the folded container and also a front and rear opening above the respective front panel and rear panel of the container. These openings enable the products contained in the container to be displayed through the openings to potential consumers of the products.

The folded product container of the invention described above provides the benefit of the reduced costs of a container formed from a single sheet of material that is folded to produce the container without requiring gluing. In addition, the novel configuration of the folded container provides four triangular cross-section columns at the four corners of the container that reinforce the container for stacking, while still allowing display of products in the container through the top opening and front and rear openings of the stacked containers.

BRIEF DESCRIPTION OF THE DRAWINGS

Further features of the present invention are set forth in the following detailed description of the preferred embodiment of the invention and in the drawing figures wherein.

DETAILED DESCRIPTION OF THE PREFERRED EMBODIMENT

Figure 1:
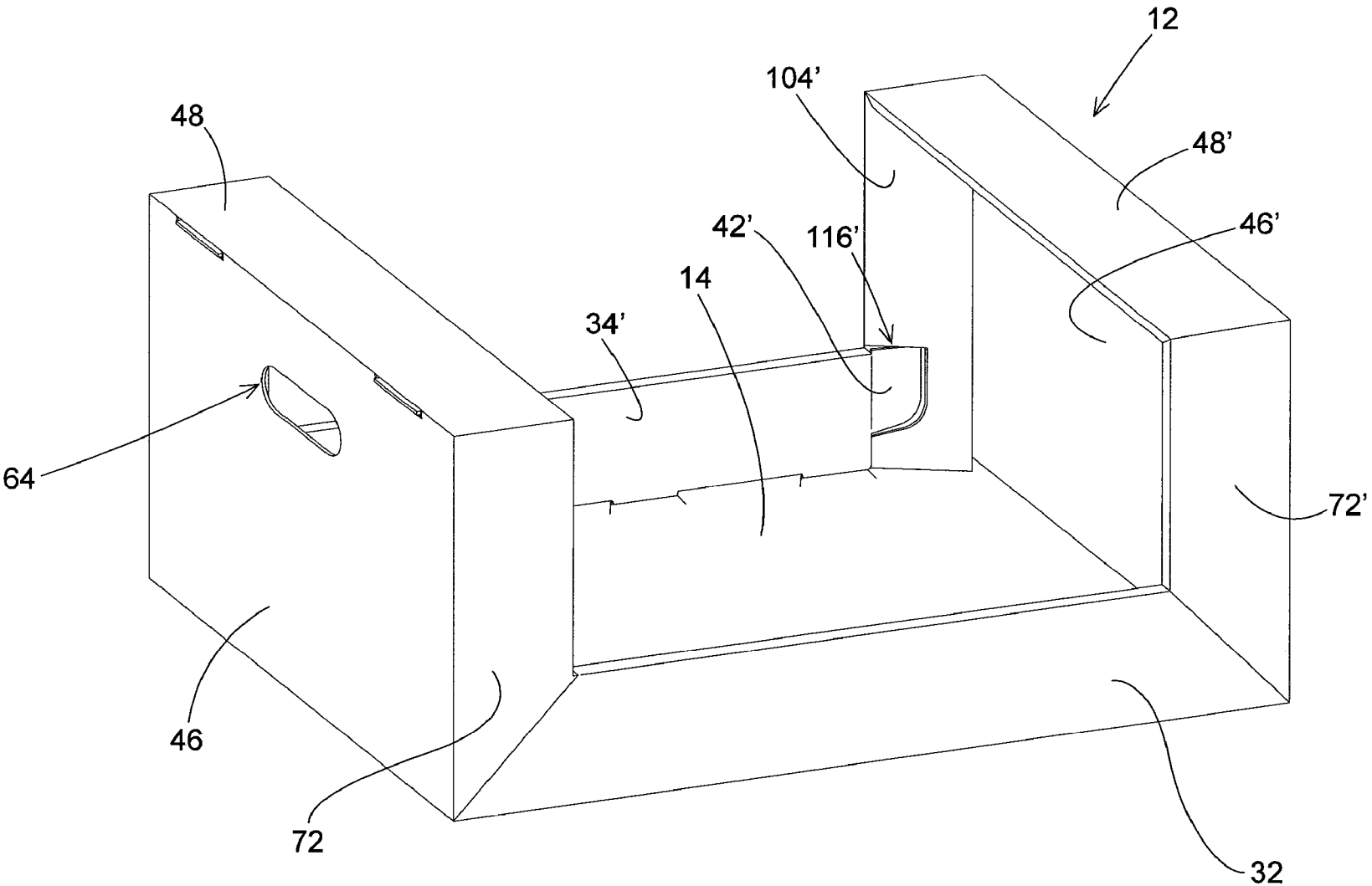
FIG. 1 is a perspective view of the folded product container of the invention.
Figure 2:
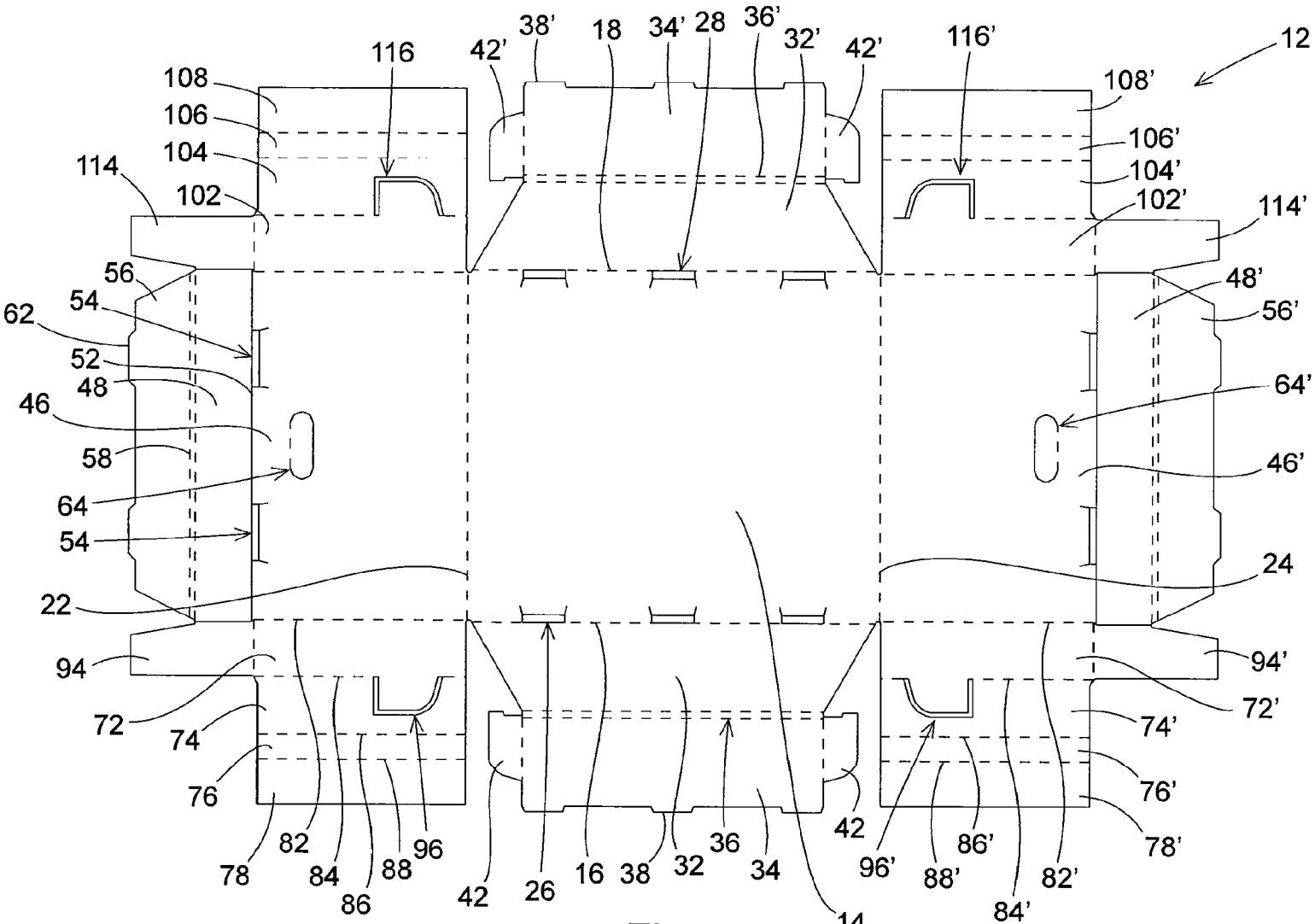
FIG. 2 is a plan view of the single sheet blank for the folded product container of the FIG. 1.

FIG. 1 is a perspective view of the folded product container 12 of the present invention in its assembled configuration. FIG. 2 is a plan view of the single sheet blank of the container 12 before it is assembled into the configuration shown in FIG. 1. The container 12 of the invention may be constructed of a single sheet of material where the material is any material that is typically used in the construction of folded containers. However, as will be evident from the following description of the assembly of the container 12 shown in FIG. 1 from the blank shown in FIG. 2, the container 12 of the invention does not use any glue or other types of adhesives or securing means in the assembly of the container 12 shown in FIG. 1.

Referring to FIG. 2, the container 12 is formed with a rectangular bottom panel 14 having parallel front 16 and rear 18 edges, and parallel left side 22 and right side 24 edges. Alternatively, the configuration of the bottom panel 14 could be square. A plurality of front edge slots 26 are formed in the bottom panel along the front edge 16, and a plurality of the rear edge slots 28 are formed in the bottom panel along the rear edge 18.

A front panel 32 is connected integrally with the bottom panel 14 along the bottom panel front edge 16. The front panel 32 has a trapezoidal configuration as shown in FIG. 2. When constructing the folded container, the front panel 32 is folded along the bottom panel front edge 16 so that the front panel extends upwardly from the bottom panel front edge 16 at a right angle orientation relative to the bottom panel 14. A front panel flap 34 is connected integrally with the front panel 32 along a fold line 36. As seen in FIG. 2, the front panel flap 34 is positioned on an opposite side of the front panel 32 from the bottom panel front edge 16. The front panel flap 34 is folded inwardly over the bottom panel 14 and downwardly so that the front panel flap 34 overlaps the front panel 32 on the interior of the folded container. A plurality of tabs 38 project from the front panel flap 34 on an opposite side of the flap from the fold line 36. The tabs 38 engage in the front edge slots 26 in the bottom panel 14 to securely hold the front panel flap 34 in its position folded over the front panel 32 in the interior of the container. The front panel flap 34 also has a pair of flanges 42 that project from opposite sides of the front panel flap 34 as shown in FIG. 2. These flanges 42 are employed in constructing rigid configuration of the container 14 to be described.

A rear panel 32' is connected integrally with the bottom panel 14 along the bottom panel rear edge 18. The rear panel 32' has the same construction as the front panel 32 described earlier, and the component parts of the rear panel 32' that correspond to the component parts of the front panel 32 are identified using the same reference numbers followed by a prime ('). It can be seen in FIG. 2 that the rear panel 32' is a mirror image of the front panel 32. Thus, the rear panel 32' includes a rear panel flap 34', a rear panel flap fold line 36' rear panel flap tabs 38' and rear panel flap flanges 42'. In assembling the container 12, the rear panel 32' is folded to extend upwardly from the bottom panel 14, the rear panel flap 34' is folded over the rear panel 32', and the rear panel flap tabs 38' are inserted in the rear edge slots 28 of the bottom panel 14.

A left side panel 46 is connected integrally with the bottom panel 14 along the bottom panel left side edge 22. In assembling the folded container 12, the left side panel 46 is folded to extend upwardly from the bottom panel left side edge 22. As seen in FIG. 2, the left side panel 46 has a rectangular configuration. The left side panel 46 also has a left top panel 48 connected integrally with the left side panel 46 along a fold line 52 that is on an opposite side of the left side panel 46 from the bottom panel 14. In assembling the folded container, the left top panel 48 is folded along the fold line 52 to a position where the left top panel 48 is substantially parallel with the bottom panel. A pair of slots 52 are provided in the left side panel 46 adjacent the fold line 52. A left top flap 56 is connected integrally with the left top panel 48 along a fold line 58 that is positioned on an opposite side of the left top panel 48 from the fold line 52 that connects the left top panel 48 with the left side panel 46. The left top flap 46 is folded under the left top panel 48 along the left top flap fold line 58 to reinforce the left top panel 48. A plurality of tabs 62 project outwardly from an opposite edge of the left top flap 56 from the left top panel 48. The tabs 62 are positioned to engage in the slots 54 in the left top panel fold line 52 when the left top flap 56 is folded under the left top panel 48 in assembling the container 12. The left side panel 46 is also provided with a hand hole 64 for carrying the folded container 12.

Figure 3:
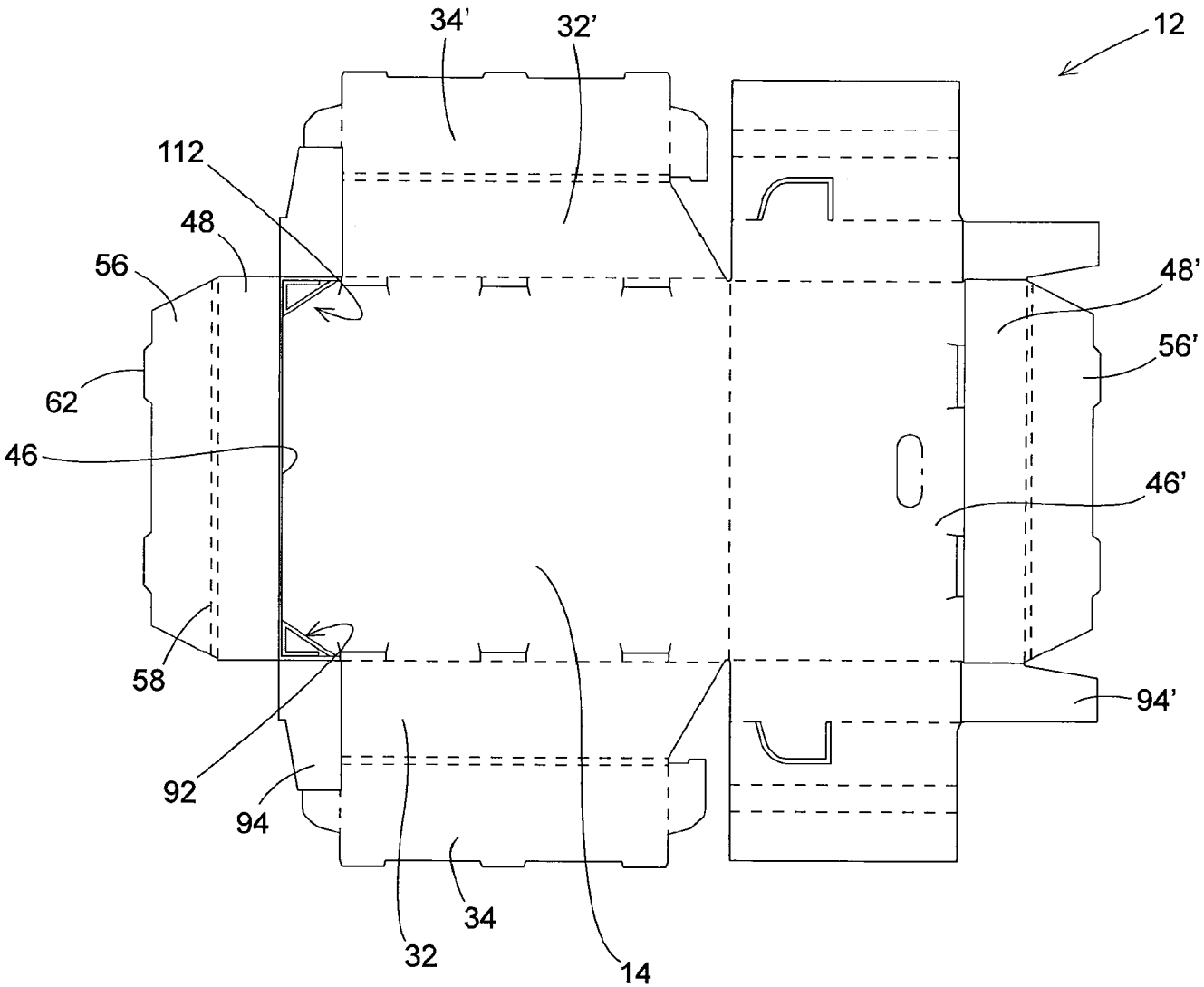
FIG. 3 is a plan view of an initial step in assembling the folded product container of FIG. 1.
Figure 5:
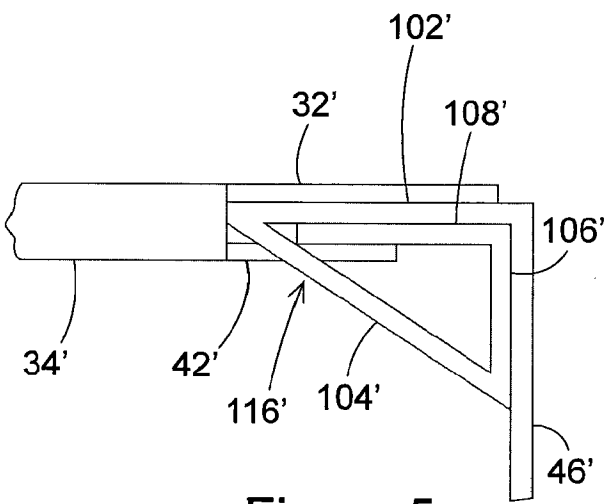
FIG. 5 is an enlarged partial view, in section, of a rear, right corner column of FIG. 1.

A plurality of front, left column panels are integrally connected to a forward edge of the left side panel 46 as shown in FIG. 2. These front left column panels include a first 72 front left column panel, a second 74 front left column panel, a third 76 front left column panel and a fourth 78 front left column panel. These panels 72, 74, 76, 78 are all integrally connected with the left side panel 46 by a plurality of respective fold lines 82, 84, 86, 88. As seen in FIG. 2, each of the column of panels 72, 74, 76, 78 has an equivalent length dimension from left to right as viewed in FIG. 2. The transverse width dimension of each panel is not the same. The first and second front left column panels 72, 74 have the same width dimensions. The fourth front left column panel 78 has a slightly smaller width dimension than the first and second front left column panels 72, 74. The third front left column panel 76 has the smallest width dimension of the four panels. These different width dimensions enable the four column panels to be folded over each other to form a hollow, tubular column. Referring to FIG. 2, the four front left column panels 72, 74, 76, 78 are folded upwardly across the respective fold lines 82, 84, 86, 88 toward the left side panel 46 in forming a front left column 92 of the container 12. The folded configuration of the front left column panels 72, 74, 76, 78 can be seen in FIGS. 3 and 5. The front, left column 92 formed is positioned in the front, left corner of the container 12 and has a hollow, tubular triangular configuration. The height dimension of the front, left column 92 corresponds to the length dimension of each of the front left column panels 72, 74, 76, 78 in constructing the folded container 12. With the front left column 92 positioned in the front left corner of the folded container 12, and the second front left column panel 74 forms a column wall that extends upwardly from the bottom panel 14 of the folded container and extends between the front panel 32 and the left side panel 46. This column wall formed by the second front left column panel 74 provides a reinforcing diagonal wall in the interior of the forward container 12 that further reinforces the container.

A left column flap 94 extends from an edge of the first front left column panel 72. The flap 94 is inserted between the left top panel 48 and the left top flap 56 after the front left column has been formed by folding over the four left column panels 72, 74, 76, 78 and after the left side panel 12 is positioned extending upwardly from the bottom panel left side edge 22, and prior to the left top flap 56 being folded under the left top panel 48. This positioning of the left column flap 94 helps hold the four front left column panels 72, 74, 76, 78 in their folded triangular column configuration.

A front, left column slot 96 is provided in the second front, left column panel 74. When the front, left column 92 is formed by folding the four front, left column panels 72, 74, 76, 78, the front, left column slot 96 is positioned to receive the left side flange 42 of the pair of flanges provided on the opposite sides of the front panel flap 34. The engagement of the flange 42 in the front, left column slot 96 securely holds the front panel flap 34 in its folded-over position adjacent the front panel 32, and securely holds the front, left column 92 in its folded configuration and the front panel 32 to the left side panel 46.

The opposite side of the left side panel 46 has four column panels integrally connected thereto. These include a first rear left column panel 102, a second rear left column panel 104, a third rear left column panel 106, and a fourth rear left column panel 108. These four panels 102, 104, 106, 108 are mirror images of the front left column panels 72, 74, 76, 78, and their assembly into a rear left column 112 is the same as the front left column 92 discussed above. The constructions of the rear left column panels 102, 104, 106, 108 and their assembly into the rear left column 112 therefore will not be repeated.

The rear left column 112 also has a rear left column flap 114 that is positioned between the left top panel 48 and the left top flap 56 in the same manner as the previously described left column flap 94 when the folded container 12 is assembled.

The rear column 112 also has a rear column slot 116. The slot 116 receives a flange 42' that projects from the rear panel flap 34' to secure the rear, left column 112 in its folded configuration and to secure the rear panel 32' to the left side panel 46'.

The container also includes a right side panel 46' that is a mirror image in construction of the left side panel 46. This can be seen in FIG. 2. Because the construction of the right side panel 46' is the same as that of the left side panel 46, the same reference numbers employed earlier in describing the component parts of the construction of the left side panel 46 are used to label the component parts of the right side panel 46', but the reference numbers are followed by a prime (').

Because the right side panel 46' is a mirror image of the left side panel 46 in construction, the specifics of the construction of the right side panel 46' will not be repeated.

Figure 4:
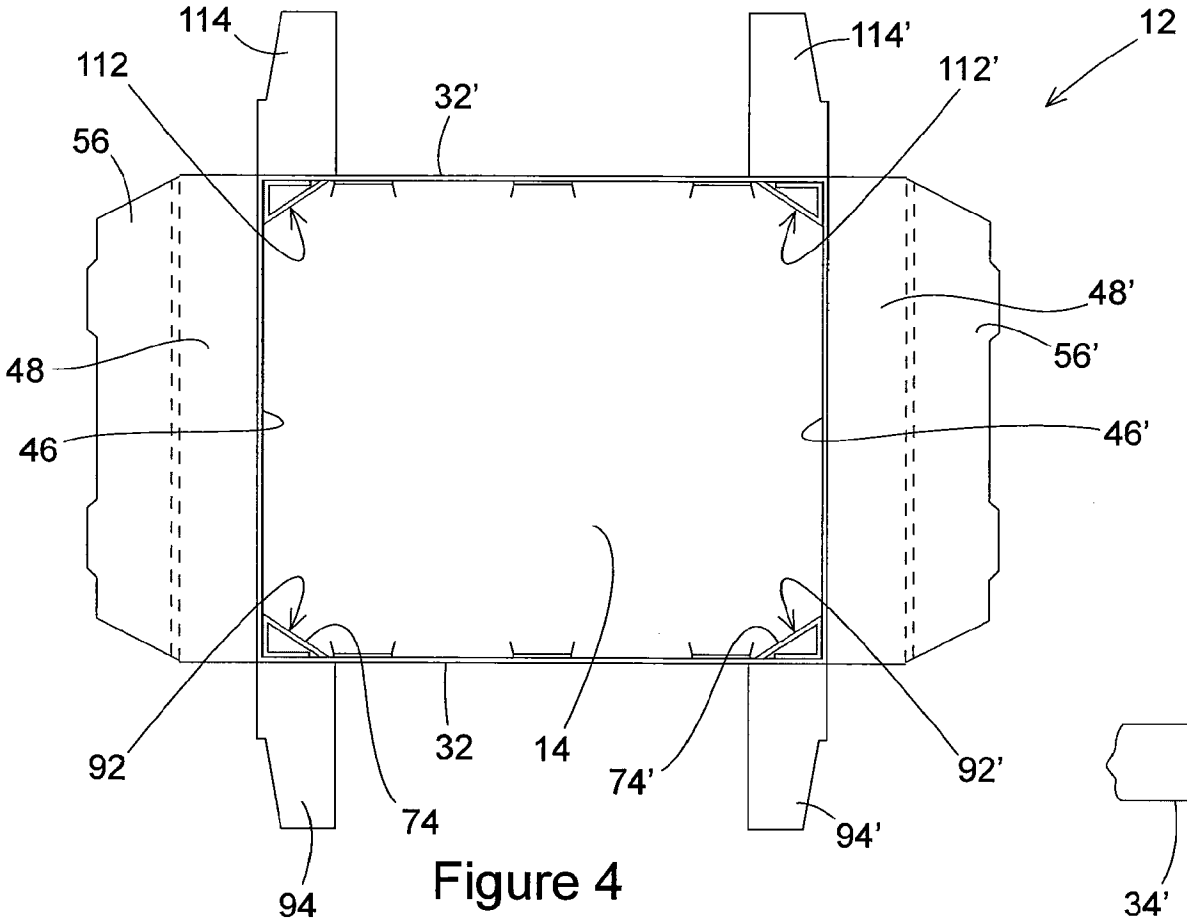
FIG. 4 is a plan view of a further step in the assembly of the folded product container of FIG. 1.

In assembling the container 12 into the folded configuration shown in FIG. 1, the left side panel 46 and right side panel 46' are positioned so that they extend upwardly from the left side edge 22 and the right side edge 24 of the bottom panel 14. The front left column 92 and the rear left column 112, and the front right column 92' and the rear right column 112' are then formed by folding over the respective front left column panels 72, 74, 76, 78 and the rear left column panels 102, 104, 106,108, and the front right column panels 72', 74', 76', 78' and the rear right column panels 102', 104', 106', 108' into their triangular cross-section column configurations shown in FIG. 4. This positions a hollow, tubular column in each of the corners of the folded container 12.

In the initial steps of folding the column panels, after the first column panels 72,102, 72', 102' are folded at right angles relative to their respective side panels 46, 46', the front left column flap 94, the rear left column flap 114, the front right column flap 94', and the rear right column flap 114' are then folded inwardly to positions that are substantially parallel over the bottom panel 14. The left, top panel 48 and the right, top panel 48' are then folded inwardly over the bottom panel 14 and over the previously-folded left column flaps 94, 114 and right column flaps 94', 114'. The left, top flap 56 is then folded underneath the left, top panel 48, the front, left column flap 94, and the rear, left column flap 114. The right, top flap 56' is folded underneath the right, top panel 48' and the front, right column flap 94' and the rear, right column flap 114'. The flap tabs 62, 62' are inserted in the slots 54, 54' in the respective left-side panel 46 and right-side panel 46' to complete the assembly of the opposite sides of the folded container 12 shown in FIG. 1. The construction of the columns 92,112, 92', 112' is then completed as discussed above.

The front panel 32 and rear panel 32' are then positioned extending upwardly from the respective bottom panel front edge 16 and bottom panel rear edge 18. The front panel flap 34 and rear panel flap 34' are then folded into the interior of the container in positions overlapping the respective front panel 32 and rear panel 32'. The tabs 38, 38' on the respective front panel flap 34 and rear panel flap 34' are then inserted into the respective front edge slots 26 and rear edge slots 28 of the bottom panel 14. The front panel flanges 42 and the rear panel flanges 42' are inserted into the front column slots 96, 96' and the rear panel flanges 42' are inserted into the rear column slots 116, 116' in completing the assembly of the folded container 12 shown in FIG. 1.

As seen in FIG. 1, the front 32 and rear 32' panels have equivalent height dimensions extending upwardly from the bottom panel 14, and the left side panel 46 and the right side panel 46' also have equivalent height dimensions extending upwardly from the bottom panel 14. The left side panel 46 and right side panel 46' height dimension is larger than the height dimension of the front panel 32 and the rear panel 32'. This produces a top opening in the folded container and also a front and rear opening above the respective front panel 32 and rear panel 32' of the container. These openings enable the products contained in the container to be displayed through the openings to potential consumers of the products.

Thus, the folded container 12 of the inventions provides a container that is folded from a single sheet of material without requiring gluing. The folded container has four tubular columns positioned at the corners of the container that reinforce the container. Furthermore, the folded container has an open top and an open front and rear that provides access to the interior of the container for using the container as a product display. The reinforced configuration of the container provided by the four columns allows the containers to be stacked.

The folded product container of the invention described above provides the benefit of the reduced cost of a container formed a single sheet of material that is folded to produce the container without requiring gluing. In addition, the novel configuration of the folded container provides four triangular cross-section columns at the four corners of the container that reinforce the container for stacking, while still allowing display of products in the container through the top opening and front and rear openings of the stacked containers.

Although the folded container of the invention has been described above by reference to a single embodiment, it should be understood that modifications and variations could be made to the container without departing from the intended scope of the following claims.

The invention claimed is:

1. A folded product container comprising:

a rectangular bottom panel with parallel front and rear edges and parallel left side and right side edges;

a front panel connected integrally with the bottom panel along the bottom panel front edge and extending upwardly from the bottom panel front edge;

a front panel flap connected integrally with the front panel along a fold line between the front panel and the front panel flap, the fold line being parallel with and on an opposite side of the front panel from the bottom panel front edge, the front panel flap being folded over the front panel and extending downwardly from the fold line across the front panel toward the bottom panel edge;

a pair of front flanges extending outwardly from opposite sides of the front panel flap;

a rear panel connected integrally with the bottom panel along the bottom panel rear edge and extending upwardly from the bottom panel rear edge;

a rear panel flap connected integrally with the rear panel along a fold line between the rear panel and the rear panel flap, the fold line between the rear panel and the rear panel flap being parallel with and on an opposite side of the rear panel from the bottom panel rear edge, the rear panel flap being folded over the rear panel and extending downwardly from the fold line between the rear panel and the rear panel flap across the rear panel toward the bottom panel rear edge;

a pair of rear flanges extending outwardly from opposite sides of the rear panel flap;

a left side panel connected integrally with the bottom panel along the bottom panel left side edge and extending upwardly from the bottom panel left side edge;

a right side panel connected integrally with the bottom panel along the bottom panel right side edge and extending upwardly from the bottom panel right side edge;

a hollow, tubular, front left column extending upwardly from the bottom panel between the front panel and the left side panel, the front left column having a slot that receives one of the pair of front flanges extending outwardly from the opposite sides of the front panel flap thereby securing both the front panel and the front panel flap to the front left column;

a hollow, tubular, front right column extending upwardly from the bottom panel between the front panel and the right side panel, the front right column having a slot that receives the other of the pair of front flanges extending outwardly from the opposite sides of the front panel flap thereby securing both the front panel and the front panel flap to the front right column;

a hollow, tubular, rear left column extending upwardly from the bottom panel between the rear panel and the left side panel, the rear left column having a slot that receives one of the pair of rear flanges that extend outwardly from the opposite sides of the rear panel flap thereby securing both the rear panel and the rear panel flap to the left rear column; and, a hollow, tubular, rear right column extending upwardly from the bottom panel between the rear panel and the right side panel, the rear right column having a slot that receives the other of the pair of rear flanges extending outwardly from the opposite sides of the rear panel flap thereby securing both the rear panel and the rear panel flap to the rear right column.

2. The folded product container of claim 1, further comprising:

the front left column, the front right column, the rear left column, and the rear right column all extending upwardly from the bottom panel at right angles relative to the bottom panel, each of the columns being formed from a plurality of column panels that are separated from each other by fold lines, and the slot of each column being in one of the fold lines that separates column panels of each of the columns.

3. The folded product container of claim 2, further comprising:

the column panels of each of the front left column, the front right column, the rear left column, and the rear right column including at least four column panels that are folded relative to each other along the fold lines separating the column panels and form each of the columns with a triangular cross-section.

4. The folded product container of claim 1, further comprising:

the four column panels of the front left column are separated from the left side panel by a fold line, the four column panels of the front right column are separated from the right side panel by a fold line, the four column panels of the rear left column are separated from the left side panel by a fold line, and the four column panels of the rear right column are separated from the right side panel by a fold line.

5. The folded product container of claim 1, further comprising:

the front left column, the front right column, the rear left column, the rear right column, the left side panel, and the right side panel each having an equivalent height dimension extending upwardly from the bottom panel.

6. The folded product container of claim 5, further comprising:

the front panel and rear panel each having an equivalent height dimension extending upwardly from the bottom panel, and the height dimension of the front panel and the rear panel being smaller than the height dimension of the front left column, the front right column, the rear left column, the rear right column, the left side panel, and the right side panel.

7. The folded product container of claim 1, further comprising:

the folded product container being cut from a single sheet of material.

8. The folded product container of claim 1, further comprising:

the folded product container being unglued.

9. The folded product container of claim 1, further comprising:

the folded product container having an open top defined by the front panel, the rear panel, the left side panel, and the right side panel.

10. A folded product container comprising:

a rectangular bottom panel with parallel front and rear edges and parallel left side and right side edges;

a front panel connected integrally with the bottom panel along the bottom panel front edge and extending upwardly from the bottom panel front edge;

a rear panel connected integrally with the bottom panel along the bottom panel rear edge and extending upwardly from the bottom panel rear edge;

a left side panel connected integrally with the bottom panel along the bottom panel left side edge and extending upwardly from the bottom panel left side edge;

a left top panel connected integrally with the left side panel along a fold line between the left top panel and the left side panel, the fold line being parallel with and on an opposite side of the left side panel from the bottom panel left side edge;

a left top flap connected integrally with the left top panel along a fold line between the left top flap and the left top panel, the left top flap being folded over the left top panel and extending across the left top panel from the fold line between the left top flap and the left top panel toward the left side panel;

a right side panel connected integrally with the bottom panel along the bottom panel right side edge and extending upwardly from the bottom panel right side edge;

a right top panel connected integrally with the right side panel along a fold line between the right top panel and the right side panel, the fold line being parallel with and on an opposite side of the right side panel from the bottom panel right side edge;

a right top flap connected integrally with the right top panel along a fold line between the right top flap and the right top panel, the right top flap being folded over the right top panel and extending across the right top panel from the fold line between the right top flap and the right top panel toward the right side panel;

a hollow, tubular front left column between the front panel and left side panel and extending upwardly from the bottom panel, the front left column having a left column flap that extends from the front left column between the left top panel and the left top flap;

a hollow, tubular front right column between the front panel and the right side panel and extending upwardly from the bottom panel, the front right column having a right column flap that extends from the front right column between the right top panel and the right top flap;

a rear hollow, tubular left column between the rear panel and the left side panel and extending upwardly from the bottom panel, the rear left column having a rear left column flap that extends from the rear left column between the left top panel and the left top flap; and, a hollow, tubular rear right column between the rear panel and the right side panel and extending upwardly from the bottom panel, the rear right column having a rear right column flap that extends from the rear right column between the right top panel and the right top flap.

11. The folded product container of claim 10, further comprising:

the front left column, the front right column, the rear left column, and the rear right column all extending upwardly from the bottom panel at right angles relative to the bottom panel.

12. The folded product container of claim 11, further comprising:

the front panel, the rear panel, the left side panel, and the right side panel all extending upwardly from the bottom panel at right angles relative to the bottom panel the column panels of each of the front left column, the front right column, the rear left column, and the rear right column including at least four column panels that are folded relative to each other along the fold lines separating the column panels and form each of the columns with a triangular cross-section.

13. The folded product container of claim 10, further comprising:

the four column panels of the front left column are separated from the left side panel by a fold line, the four column panels of the front right column are separated from the right side panel by a fold line, the four column panels of the rear left column are separated from the left side panel by a fold line, and the four column panels of the rear right column are separated from the right side panel by a fold line.

14. The folded product container of claim 10, further comprising:

the front left column, the front right column, the rear left column, the rear right column, the left side panel, and the right side panel each having an equivalent height dimension extending upwardly from the bottom panel.

15. The folded product container of claim 14, further comprising:

the front panel and rear panel each having an equivalent height dimension extending upwardly from the bottom panel, and the height dimension of the front panel and the rear panel being smaller than the height dimension of the front left column, the front right column, the rear left column, the rear right column, the left side panel, and the right side panel.

16. The folded product container of claim 10, further comprising:

the folded product container being cut from a single sheet of material.

17. The folded product container of claim 10, further comprising:

the folded product container being unglued.

18. The folded product container of claim 10, further comprising:

the folded product container having an open top defined by the front panel, the rear panel, the left side panel, and the right side panel.

* * * * *